United States Patent [19]

Jackson

[11] 3,953,245

[45] Apr. 27, 1976

[54] PROCESS FOR THE PRODUCTION OF DRAWING STEEL

[75] Inventor: Paul L. Jackson, Dearborn, Mich.

[73] Assignee: Ford Motor Company, Dearborn, Mich.

[22] Filed: Sept. 16, 1971

[21] Appl. No.: 181,210

Related U.S. Application Data

[63] Continuation of Ser. No. 793,884, Jan. 24, 1969, abandoned.

[52] U.S. Cl. ..... 148/3; 75/58; 148/134

[51] Int. Cl.[2] ..... C21C 7/06

[58] Field of Search ..... 75/129, 58, 123 B, 123 L, 75/128 N; 148/36, 3, 134

[56] References Cited

UNITED STATES PATENTS

| | | | |
|---|---|---|---|
| 2,705,196 | 3/1955 | Wever et al. | 75/58 |
| 2,705,673 | 4/1955 | Jordan | 75/58 |
| 2,772,154 | 11/1956 | Morgan | 75/123 B |
| 2,999,749 | 9/1961 | Saunders | 75/123 B |
| 3,348,980 | 10/1967 | Enrietto | 148/16 |
| 3,368,886 | 2/1968 | Muta et al. | 148/12 |
| 3,412,781 | 11/1968 | Richards | 75/58 X |

OTHER PUBLICATIONS

The Making, Shaping and Treating of Steel, 8th Ed., 1964, pp. 337–344, 445, 453–457, 1069–1071 and 1076–1079.

Transactions of the ASM, Vol. 58, 1965, pp. 672 & 673.

*Primary Examiner*—Arthur J. Steiner

*Attorney, Agent, or Firm*—Joseph W. Malleck; Keith L. Zerschling

[57] ABSTRACT

This invention teaches the production of drawing quality carbon steel with a superior ingot yield. This steel is non-strain aging and is dependent upon the use of a carefully controlled silicon and manganese content to yield a final oxygen content of between 0.01% and 0.03%.

2 Claims, No Drawings

PROCESS FOR THE PRODUCTION OF DRAWING STEEL

This application is a continuation of application Ser. No. 793,884 filed Jan. 24, 1969 now abandoned.

THE INVENTION

This invention is intended as an alternative to the usual rimming steels which are produced in large quantities in this country where deep drawing qualities are required. This steel retains the deep drawing qualities of rimmed steel and in addition offers a superior ingot yield because less ingot cropping is required. The surface of ingots produced by this process is superior to those produced by conventional rimming steel because the unpredictable effervescing action of the metal in the mold is substantially eliminated.

The chemistry of these steels is basically similar to that of conventional rimmed steel with a maximum carbon content of about 0.07% and a preferred carbon range in the vicinity of 0.03% to 0.06%. The phosphorus and sulfur are held as low as economically feasible and the nitrogen content ranges from as low as 0.002% to 0.010%. The steel is free of harmful amounts of copper and tin which detract from the deep drawing qualities. This steel can be produced in either the open hearth or the basic oxygen furnace.

The distinguishing feature of these steels as compared to conventional rimming deep drawing steel is the much lower oxygen content of the melt. The oxygen content of the melt as it is teemed should not depart significantly from the range of 0.01% to 0.03%. This oxygen content is established by a synergistic action between the deoxidants employed, that is, the silicon and manganese.

A preferred process mode for obtaining an improved yield of drawing quality non-rimmed carbon steel which is non-strain aging (both carbon and nitrogen) and which has a carbon content not substantially in excess of 0.07%, comprises: (*a*) subjecting a ferrous melt effectively free of copper and tin impurities to the action of an oxidizing ambient until the carbon content of the melt has been reduced to not over 0.07% and the silicon content to not over 0.02%, said melt having a nitrogen content of at least 0.002%, (*b*) isolating the ferrous melt so treated from the oxidizing ambient and establishing a manganese content in the melt to neutralize the adverse effects of any residual sulfur, (*c*) adding sufficient silicon to yield a dissolved silicon content of at least .07% to the melt to act in synergism with the manganese content of the melt to establish an oxygen content of the melt from about 0.01% to 0.03%, (*d*) subject the solidification of said melt to a subcritical anneal followed by slow cooling at a rate programmed to avoid carbon strain aging, the resulting solidification being characterized by an aging index no greater than 5%.

This invention can be readily understood by a study of the chemistry of sixteen heats which have been prepared to establish the non-strain aging qualities of the steels of this invention. The table presented infra has been divided into a First Group and a Second Group, each of which detail the chemistry of eight heats. The sole significant distinction between the First Group and the Second Group lies in the higher carbon content of the Second Group.

First Group

| Steel | Carbon | Manganese | Phosphorus | Sulfur | Nitrogen | Silicon |
|---|---|---|---|---|---|---|
| A | .043 | .36 | .010 | .022 | .0071 | .006 |
| B | .040 | .35 | .010 | .022 | .0075 | .018 |
| C | .036 | .35 | .010 | .022 | .0079 | .025 |
| D | .040 | .35 | .010 | .022 | .0064 | .043 |
| E | .041 | .36 | .010 | .022 | .0050 | .075 |
| F | .042 | .35 | .010 | .022 | .0065 | .10 |
| G | .040 | .35 | .010 | .022 | .0075 | .15 |
| H | .040 | .35 | .010 | .022 | .0061 | .20 |

Second Group

| Steel | Carbon | Manganese | Phosphorus | Sulfur | Nitrogen | Silicon |
|---|---|---|---|---|---|---|
| 1 | .092 | .38 | .009 | .021 | .0091 | .013 |
| 2 | .111 | .37 | .009 | .022 | .0095 | .025 |
| 3 | .113 | .37 | .008 | .022 | .0062 | .032 |
| 4 | .131 | .38 | .009 | .024 | .0072 | .055 |
| 5 | .136 | .38 | .007 | .024 | .0063 | .076 |
| 6 | .121 | .33 | .008 | .024 | .0095 | .095 |
| 7 | .123 | .37 | .008 | .025 | .0069 | .15 |
| 8 | .126 | .38 | .007 | .024 | .0098 | .195 |

The carbon values noted above are combustion values, and the nitrogen analyses were done by the kjeldahl method. The other elements were determined spectrographically.

The five pound ingots from both groups of heats were hot rolled to ⅝ inch diameter bars which were quenched from 1600°F at a rate found by trial to approximate the quenching rate achieved just prior to the coiling of hot band in conventional steel making practice. Sections from these bars were then given a subcritical anneal, after which they were machined to ⅜ inch diameter test bars; pulled in a tensile machine to 10% elongation; aged for one hour in boiling water, and pulled to failure. The first group of test bars, because of their abnormally low carbon contents, required an exceedingly slow cooling rate from 1300°F; one programmed to avoid carbon strain aging. The results were as follows:

| Steel | Load at 10% Elongation | Upper Yield Load After Subsequent Aging for One Hour at 100°C | Aging Index % |
|---|---|---|---|
| A | 5100 | 6400 | 25.5 |
| B | 4920 | 6060 | 23.2 |
| C | 4970 | 6310 | 26.0 |
| D | 4730 | 5580 | 18.0 |

-continued

| Steel | Load at 10% Elongation | Upper Yield Load After Subsequent Aging for One Hour at 100°C | Aging Index % |
|---|---|---|---|
| E | 4700 | 4960 | 5.5 |
| F | 4800 | 4800 | 0 |
| G | 4820 | 4850 | 0.6 |
| H | 5030 | 5060 | 0.6 |

The actual shape of the stress-strain curves indicate that for all practical purposes the strain aging effect for Specimen E was very minor and that Specimens F, G, and H did not age.

The second group of steels were amenable to a subcritical anneal programmed to duplicate the normal drawing quality box anneal which has long been employed in the steel industry. The tensile test results were as follows:

| Steel | Load at 10% Elongation | Upper Yield Load After Subsequent Aging for One Hour at 100°C | Aging Index % |
|---|---|---|---|
| 1 | 5160 | 6120 | 18.60 |
| 2 | 5280 | 6230 | 18.00 |
| 3 | 5320 | 6430 | 20.87 |
| 4 | 5470 | 5920 | 8.23 |
| 5 | 5355 | 5440 | 1.59 |
| 6 | 5260 | 5305 | 0.85 |
| 7 | 5390 | 5400 | 0.19 |
| 8 | 5670 | 5720 | 0.88 |

In these tables the aging index was obtained by subtracting the load at ten percent elongation from the upper yield load after aging and dividing the result by the elongation at ten percent elongation and multiplying by 100.

These results demonstrate that the aging of these steels was not dependent upon their carbon content since the high and low carbon specimens aged substantially identically. The aging which was observed was almost certainly due to the nitrogen content. It is apparent that the presence of about 0.07% silicon together with about 0.35% manganese required to neutralize the 0.02% sulfur resulted in a steel having sufficient oxygen to attain excellent ingot yields and at the same time to be immune to nitrogen strain aging.

I claim as my invention:

1. A process for obtaining an improved yield of drawing quality non-rimmed carbon steel which is non-strain aging and which has a carbon content not substantially in excess of 0.07% comprising subjecting a ferrous melt effectively free of copper and tin impurities to the action of an oxidizing ambient until the carbon content of the melt has been reduced to not over 0.07% and the silicon content to not over 0.02%, said melt having a nitrogen content of at least 0.002%, isolating the ferrous melt so treated from the oxidizing ambient, establishing a manganese content in the melt to neutralize the adverse effects of any residual sulfur, adding sufficient silicon to yield a dissolved silicon content of at least 0.07% to the melt to act in synergism with the manganese content of the melt to establish an oxygen content of the melt of from about 0.01% to 0.03%, and subjecting an ingot solified from said melt to a subcritical anneal followed by slow cooling at a rate programmed to avoid carbon strain aging, the resulting ingot being characterized by an aging index no greater than 5%.

2. The process recited in claim 1 in which the manganese content is about 0.35% and the silicon content is about 0.07% to 0.10%.

* * * * *